US005216757A

United States Patent [19]

Dorkin

[11] Patent Number: 5,216,757

[45] Date of Patent: Jun. 8, 1993

[54] KNOT SIMULATING NECK TIE CLASP

[76] Inventor: Joshua Dorkin, 1965 S. Ocean Dr., #Ph-A, Hallandale, Fla. 33009

[21] Appl. No.: 908,363

[22] Filed: Jul. 6, 1992

[51] Int. Cl.[5] ..... A41D 27/20

[52] U.S. Cl. ..... 2/152 R; 2/152 A; 2/153; 2/148; 2/144; 2/145

[58] Field of Search ..... 2/152 R, 152 A, 153, 2/148, 144, 145; 24/9, 49 R, 49 CF, 49 KC

[56] References Cited

U.S. PATENT DOCUMENTS

| | | | |
|---|---|---|---|
| 384,036 | 6/1888 | Hellenberg | 2/152 R |
| 1,949,851 | 3/1934 | Alper | 2/150 |
| 2,450,471 | 10/1948 | Dorkin | 2/152 |
| 2,465,947 | 3/1949 | Ve Relle | 2/153 |
| 2,528,356 | 10/1950 | Fruns | 2/152 |
| 2,553,437 | 5/1951 | Burke | 2/150 |
| 2,617,108 | 11/1952 | Anzell | 2/153 |
| 2,787,002 | 4/1957 | De La Piedra | 2/153 |
| 3,745,614 | 7/1973 | Tsang | 2/152 |
| 3,964,105 | 6/1976 | Gideon | 2/152 R |
| 4,542,537 | 9/1985 | Plapp et al. | 2/152 R |
| 4,573,219 | 3/1986 | Hooten | 2/152 R |
| 4,748,692 | 6/1988 | Fukushima | 2/152 R |
| 4,977,624 | 12/1990 | Stafford | 2/152 R |

FOREIGN PATENT DOCUMENTS

| | | | |
|---|---|---|---|
| 0254546 | 1/1988 | European Pat. Off. | 2/152 R |

*Primary Examiner*—Andrew M. Falik
*Assistant Examiner*—Gloria Hale
*Attorney, Agent, or Firm*—Oltman and Flynn

[57] ABSTRACT

A tie knot apparatus is provided which includes a front shell member having a top edge, a bottom edge, and first and second side edges, a rear shell member having a top edge, a bottom edge, and first and second side edges, the shell members being configured at the top and bottom edges to form an upper shell member opening and a lower shell member opening, the openings being for passing a neck tie, a joining mechanism on the first and second side edges for joining the front and rear shell members together. The bottom edges are preferably contoured at the lower shell member opening to create aesthetically appealing folds in the tie below the apparatus. A wedge member is optionally secured to one of the shell members for pressing against the tie and creating an aesthetically appealing fold in the tie adjacent to the apparatus. One of the joining mechanisms preferably includes a hinge for the shell members. The front shell member preferably has an exterior surface shaped to resemble the appearance of a tie knot. A pin member preferably extends from one of the shell members toward the other shell member for piercing a neck tie placed between the shell members and for securing the apparatus to the tie.

12 Claims, 4 Drawing Sheets

KNOT SIMULATING NECK TIE CLASP

BACKGROUND OF THE INVENTION

1. Field of the Invention

The present invention relates generally to the field of neck ties, and more specifically to a simulated tie knot which includes a shell member for placing around and securing a neck tie to a wearer, the shell member having an outer section which extends across the outer face of the tie and an inner section which extends across the rear face of the tie, the sections being joined together adjacent to a side of the tie by a hinge, and having fastening means located opposite the hinge, the shell member having an upper opening and a lower opening through which the tie passes, such that the wearer releases the fastener means, opens the shell member on the hinge, places the tie into the shell member and aligns it with the openings, then the wearer pivots the sections together so that the fastener means are engaged to hold the shell member closed.

2. Description of the Prior Art

There have long been clasps for securing neck ties to shirts. Most of these clasps have been designed to supplement the knot made in the neck tie between the front flaps of the collar. A problem with making a knot by hand each time a tie is worn is that it can be difficult to position the knot properly. The wearer may repeatedly tie the knot, each time only to find to his frustration that one end of the tie is conspicuously lower than the other end. Several neck tie inventions have been developed to overcome this problem. Many are complicated and awkward to use. In all cases, a problem with these inventions is that the tie emerges from below the device with a smooth outer surface. A tied tie would normally have a vertical split below the knot, and the absence of the split amplifies the artificial appearance.

Safford, U.S. Pat. No. 4,977,624, issued on Dec. 18, 1990, teaches a simulated tie knot device in the form of a flexible sheet of material which wraps around the tie. Fasteners are located on protruding ear portions which overlap when the sheet is fitted around the tie. The fastened device is cone-shaped with a wide open top and a narrow open bottom through which the tie passes. Arcuate openings at either side of the device receive a tie T-member extending around the neck of the wearer. A problem with Safford is that the soft, flexible sheet is unable to asthetically shape the tie portions adjacent the device. Another problem is that Safford lacks the bulk of a real tie knot, and so does not look convincing.

Fukushima, U.S. Pat. No. 4,748,692, issued on Mar. 4, 1988, discloses another substitute tie knot device in the form of an inverted cone-cylinder made of an elastic material. A longitudinal split is provided in the back of the device creating right and left rear portions. The tie is placed around the neck of the wearer, the split is pulled open and the tie is fitted laterally through the split. Then the split is permitted to resiliently spring closed, and fastening means on the left and right portions are joined together to secure the device. A problem with the disclosed spring-loaded hook and loop fastening mechanism is that it would be relatively complicated and expensive to manufacture. Another problem is that the fastening mechanism could pierce and tear the shirt or tie. Still another problem is that the rearward-facing fastening mechanism could be awkward to reach and operate, thus defeating the simplifying purpose of the device.

Hooten, U.S. Pat. No. 4,573,219, issued on Mar. 4, 1986 teaches a necktie knot simulator in the form of a member in the shape of an inverted, truncated triangle. Two channels extending from opposing upper corners of the triangle curve through the member and both exit through the lower corner of the triangle. One channel is located in front of the other, and the wider end of the tie is fitted down through this front channel. The narrower end of the tie is fitted down through the rear channel. A transparent adhesive layer is provided on the front of the tie to hold the member in place. A problem with Hooten is that, since the tie must be provided with the adhesive layer or other fastening means, a conventional, off the shelf tie could not be used without some modification. Another problem is that the member cannot be quickly and conveniently placed around the tie, but the tie must be fed through the member first, and then both put on the wearer. Then the sliding and adjustment problem associated with ordinary knot tying is presented.

Gideon, U.S. Pat. No. 3,964,105, issued on Jun. 22, 1976, discloses a tie knot simulator including a front shield member shaped to resemble a tie knot. The tie is positioned around the wearer's neck, and the shield member is placed over the tie at the location where the knot would normally be tied. Then two upper fasteners and a lower clasp on the back of the shield member are clipped to and around the tie to hold the shield member and tie in place. A problem with Gideon is that the wearer is put through the awkward task of clipping all three of the rear-mounted fasteners in place by touch. Another problem is that since the shield member does not extend around the tie, but rather terminates in thin edges at the sides of the tie, it does not convincingly resemble a real tie knot.

De La Piedra, U.S. Pat. No. 2,787,002, issued on Apr. 2, 1957, reveals a tie knot simulator including a trapezoidal sheet of transparent material bent around its minor axis to form a cone-like configuration. Opposed ends in the shape of rounded points overlap on the rear side of the cone. The tie is slid through the cone, and either the internal friction of the cone or an added adhesive holds it in place on the tie. A decorative outer layer of fabric may be provided. A problem with De La Piedra is that the internal friction grip of the cone may often be insufficient, as when the wearer moves around frequently or when a high wind catches the tie ends, to hold the device in place. The cone may slip out of place, and possibly without the knowledge of the wearer. On the other hand, using the suggested adhesive may damage a conventional tie. Another problem is that, once again, the device cannot simply be fitted around an already-positioned tie, but must instead be fitted over one end of the tie before the tie is put on the wearer. Then the other end of the tie must be fitted through the device and the tie and device adjusted into the desired position. This procedure may be more bothersome than tying a tie in the conventional way.

Anzell, U.S. Pat. No. 2,617,108, issued on Nov. 11, 1952, discloses another plastic necktie knot. Anzell includes a tie retaining member in the form of an inverted, truncated shell. The shell is flatted to form a front and a rear face, and the rear face has a longitudinal slot for receiving the tie. The tie is positioned on the wearer and the member is fitted around the tie where the tie knot would normally be located. Then a bow-shaped spring on a hinge is pivoted into and locked within the slot so that the spring bears against the tie. The spring is intended to grip the tie so that the member does not slide out of position. The member front face may be decorated such as with an ornate button. A problem with Anzell is that the tie may be difficult to squeeze into the slot, and the hinged spring member on the rear face may be awkward to operate by touch. The spring mechanism also makes Anzell relatively complex, expensive and subject to failure.

Burke, U.S. Pat. No. 2,553,437, issued on May 15, 1951 teaches a knot device for a necktie much like that of Anzell. A flattened, cone-shaped shell has a slot in the rear face to permit resilient gripping of the tie by the shell. In this instance, however, there is no spring or other member to close over the slot. The interior surface is covered with an intermeshing or entangling material for engaging the fabric of the tie to hold the device in position. A problem with Burke is that the tie must be fed through and positioned within the device, making attachment of the device almost as laborious as tying a knot.

Ve Relle, U.S. Pat. No. 2,465,947, issued on Mar. 29, 1949 teaches a simulated tie knot including a spring clasp which crimps the tie and a shell as in Burke which fits over and engages the clasp. A problem with Ve Relle is that the clasp must be carefully positioned on the tie so that the shell attaches with the front directly forward. This makes for a potentially awkward combination of steps.

Alper, U.S. Pat. No. 1,949,851, issued on Mar. 6, 1934, teaches another conical tie member, this one having an internal pin for holding the member in place on the tie. A problem with Alper is that it is awkward to fit the tie into the member.

Hellenberg, U.S. Pat. No. 384,036, issued on Jun. 5, 1888, discloses a tie fastener in the form of a clasp with a hinged rear panel. The tie is positioned on the wearer and the clasp is placed around the tie and closed. A problem with Hellenberg is that the flat clasp does not create a very convincing tie knot appearance.

Tsang, U.S. Pat. No. 3,745,614, issued on Jul. 17, 1973, teaches a tie-knot unit including two triangular casing portions hinged together at their top edges and contoured to form openings at all three corners. An end of the tie enters each top opening and both exit through the common bottom opening. Interlocking stud members are provided inside the casing around which the tie ends weave. This feature enhances the friction grip of the casing to help keep it from sliding down the tie. Alternatively, a hinged loop member is provided inside the casing. A problem with Tsang is that the wearer has to position the tie while the tie rests inside the rear casing portion. This would be awkward since the top portion would be opened out under the jaw of the wearer during this adjustment. Furthermore, the wearer would need one hand to hold each end of the tie and still another hand to hold the device, all simultaneously.

Fruns, U.S. Pat. No. 2,528,356, issued on Oct. 31, 1950, discloses a knot simulating necktie clip in the form of a ring member shaped to provide a relatively narrow upper rim and a wider lower band with side flanges tapering toward the rim. The ring is bent upon itself intermediate the rim and the band to provide a relatively narrow passage between the side flanges. The side flanges are disposed to confine and shape a tie into a simulated knot, with the rim and band disposed to define the upper and lower marginal portions of the knot at the front of the tie. A problem with Fruns is that it is an awkward shape to mold and thus potentially costly to produce. Another problem is that the tie may slip out of the ring. Finally, Fruns does not form a convincing looking tie knot.

Dorkin, U.S. Pat. No. 2,450,471, issued on Oct. 5, 1948, discloses a cord device for aiding in tying neck ties, but is not a simulated neck tie.

It is thus an object of the present invention to provide a neck tie knot clasp in the form of a shell, shaped and colored to simulate a neck tie knot.

It is another object of the present invention to provide such a clasp which can be easily fastened around the tie, either over or in place of a conventional tie knot, with one hand on the clasp and the other on the tie.

It is another object of the present invention to provide such a clasp which thereby makes the rear end segment of the tie unnecessary to securing the tie, and which can therefore secure a tie made of substantially less material.

It is still another object of the present invention to provide such a clasp which has a lower orifice through which the tie fits, and the orifice is contoured to create visually appealing vertical bends in the tie.

It is finally an object of the present invention to provide such a tie which is simple in design, reliable and inexpensive to manufacture.

SUMMARY OF THE INVENTION

The present invention accomplishes the above-stated objectives, as well as others, as may be determined by a fair reading and interpretation of the entire specification.

A tie knot apparatus is provided which includes a front shell member having a top edge, a bottom edge, and first and second side edges, a rear shell member having a top edge, a bottom edge, and first and second side edges, the shell members being configured at the top and bottom edges to form an upper shell member opening and a lower shell member opening, the openings being for passing a neck tie, a joining mechanism on the first and second side edges for joining the front and rear shell members together. The bottom edges are preferably contoured at the lower shell member opening to create aesthetically appealing folds in the tie below the apparatus. A wedge member is optionally secured to one of the shell members for pressing against the tie and creating an aesthetically appealing fold in the tie adjacent to the apparatus. One of the joining mechanisms preferably includes a hinge for the shell members. The front shell member preferably has an exterior surface shaped to resemble the appearance of a tie knot. A pin member preferably extends from one of the shell members toward the other shell member for piercing a neck tie placed between the shell members and for securing the apparatus to the tie. One of the joining mechanisms preferably removably fastens the shell members together.

A neck tie is also provided in the form of an elongate strip of flexible material, of a length permitting the neck tie to extend from the area of a wearer's trouser belt vertically upward and around the wearer's shirt collar and terminating just below the collar. The apparatus optionally includes a loop member for fitting under a wearer's shirt collar and a support cord connecting the loop member to one the shell member. The loop member is an elongate strip of fabric having two ends and having a loop fastening mechanism at one of the ends. Alternatively, the loop member is a chain having two ends and having a fastening mechanism at one of the ends.

An apparatus is more generally provided for securing an elongate article of clothing, including a front shell member having a top edge, a bottom edge, and first and second side edges, a rear shell member having a top edge, a bottom edge, and first and second side edges, the shell members being configured at the top and bottom edges to form an upper shell member opening and a lower shell member opening, the openings being for passing the article of clothing, a joining mechanism on the first and second side edges for joining the front and rear shell members together.

BRIEF DESCRIPTION OF THE DRAWINGS

Various other objects, advantages, and features of the invention will become apparent to those skilled in the art from the following discussion taken in conjunction with the following drawings, in which.

the open position, revealing the hinge and fastening mechanism.

Figure 2:
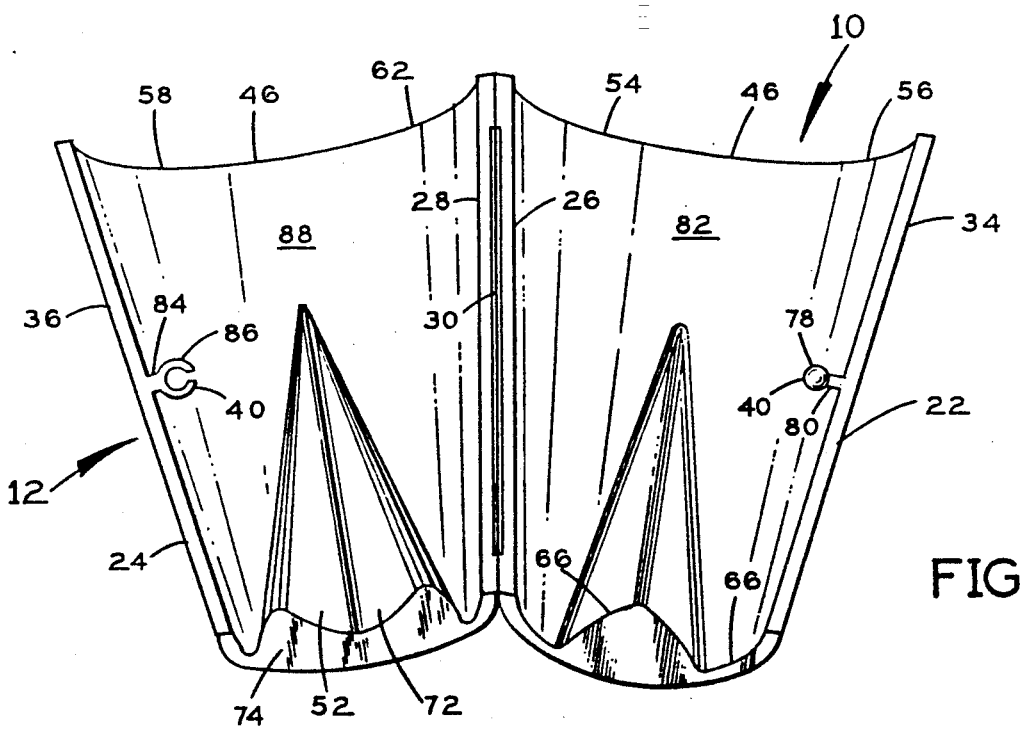
Figure 3:
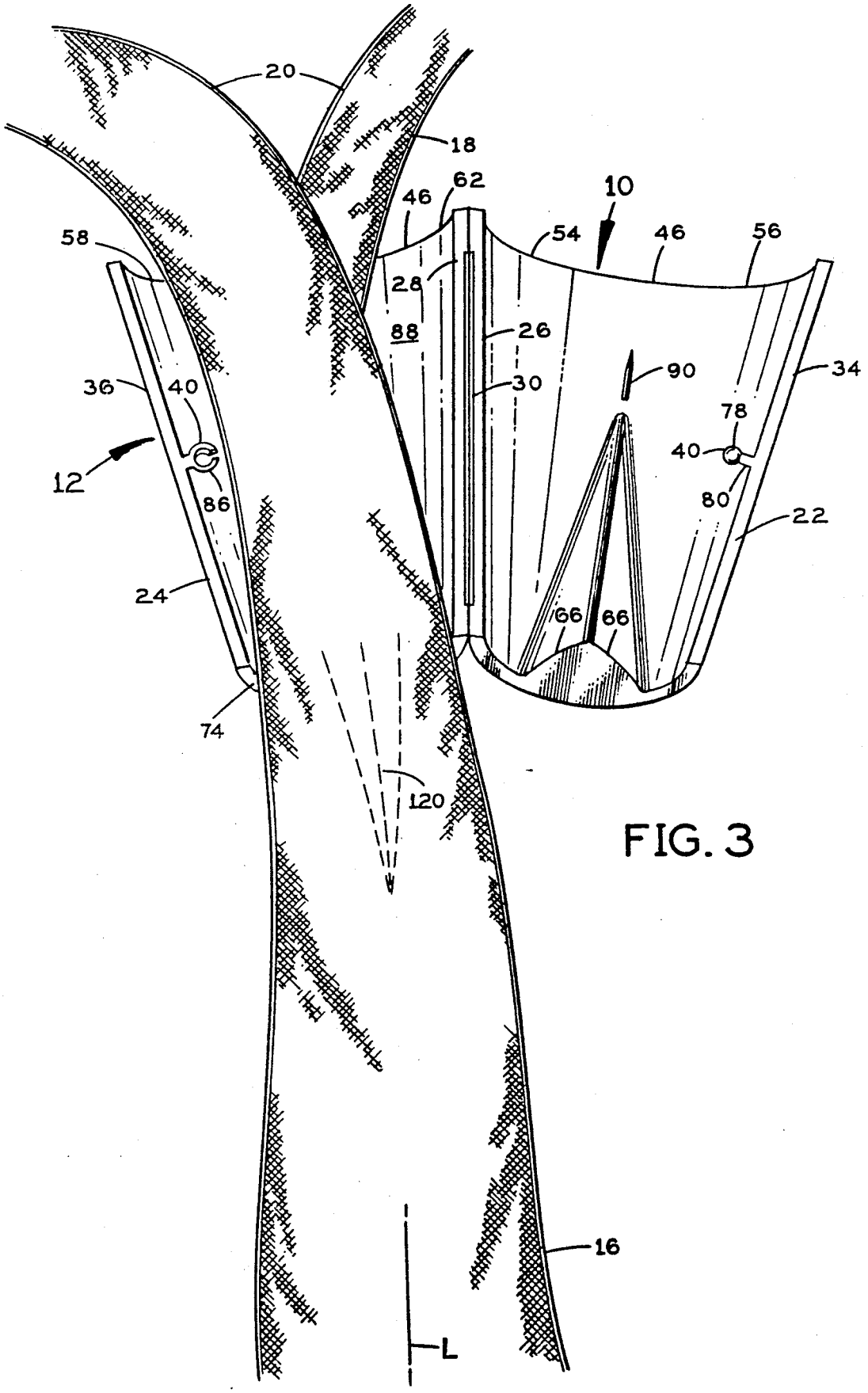

FIG. 3 is a perspective top view as in FIG. 2, with the tie fit into the inner shell section, and having a securing pin attached to the inner surface of the outer shell section.

Figure 4:
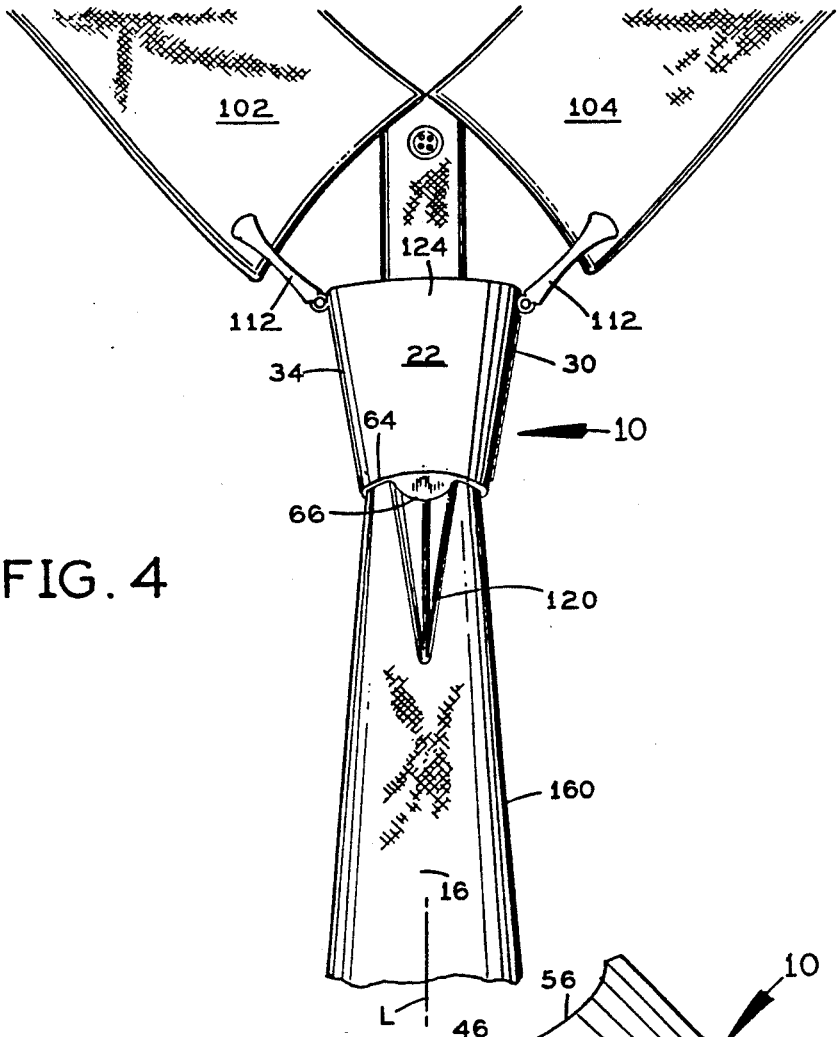

FIG. 4 is a front view of the embodiment of the inventive apparatus having clasps extending from the shell member and clipped to the flaps of a shirt collar, and of the shortest version of the modified tie.

Figure 5:
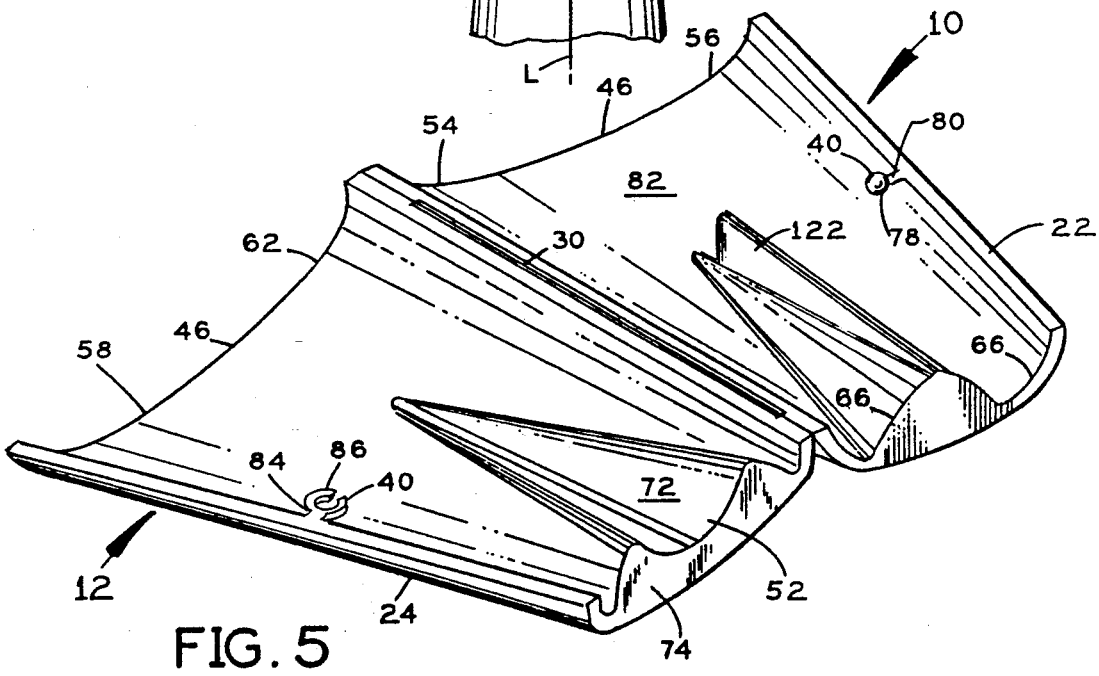

FIG. 5 is a perspective top view of the apparatus of FIG. 2, in the open position, revealing the hinge and fastening mechanism, and additionally having the optional wedge member.

Figures 6, 7, 8:
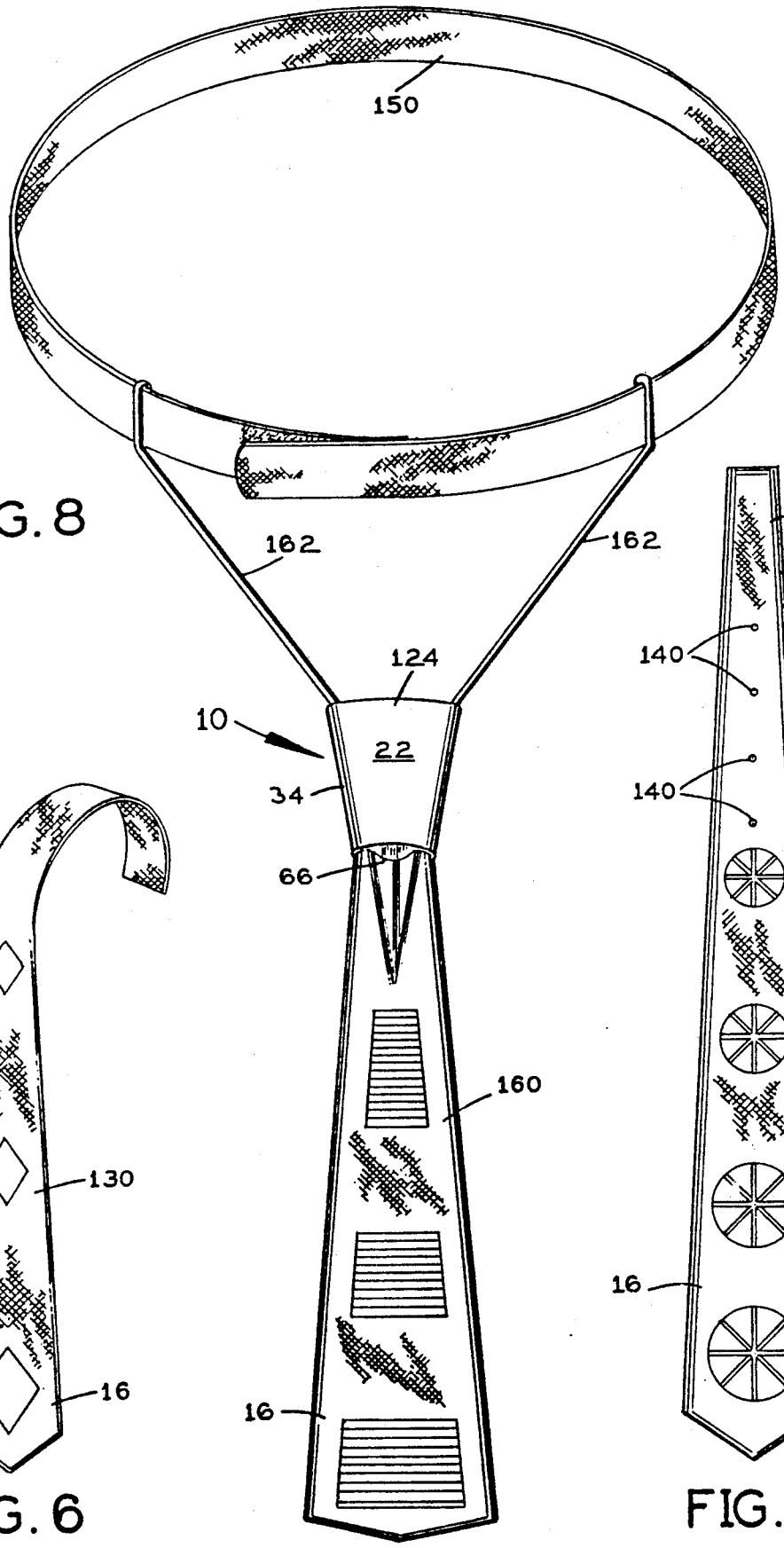

FIG. 6 is a front view of the first inventive tie, having no vertical narrow section.

FIG. 7 is a back view of a tie having the apparatus positioning dots.

FIG. 8 is a front view of the embodiment of the inventive apparatus having a loop member under the collar and connecting cords extending from the shell member to the loop member, and the shortest version of the modified tie.

DETAILED DESCRIPTION OF THE PREFERRED EMBODIMENTS

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Embodiment

Figure 1:
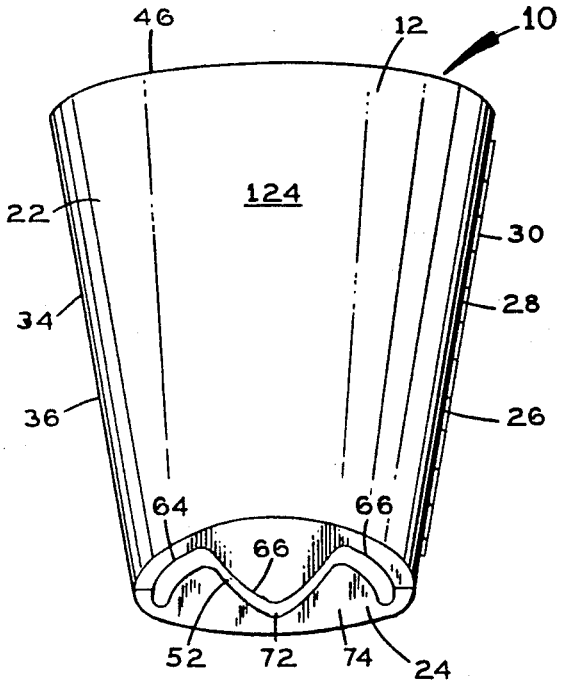
FIG. 1 is a perspective top view of the preferred embodiment of the inventive apparatus, in the closed position.

Referring to FIG. 1, a tie knot apparatus 10 is disclosed including a shell member 12 for placing around and securing a neck tie 20 to a wearer. Tie 20 is an elongate strip of fabric which tapers in width from one end to the other. The middle section of tie 20 is wrapped around the neck of the wearer under the shirt collar 14 and secured so that the wider end 16 hangs vertically in front of the narrower end 18. Shell member 12 is placed around ends 16 and 18 of tie 20 between the flaps of collar 14, where a knot is conventionally tied.

Shell member 12 has an outer section 22 which extends across wider end 16 and an inner section 24 which extends across narrower end 18. Sections 22 and 24 are preferably joined together at side edge 26 of section 22 and side edge 28 of section 24, by a hinge 30. See FIG. 2. For a right handed version of apparatus 10, hinged edges 26 and 28 are located on the left side of shell member 12, and for a left-handed version, hinged edges 26 and 28 are located on the right side. Fastening means 40 are located on edge 34 of section 22 and edge 36 of section 24, opposite edges 26 and 28.

Shell member 12 has an upper opening 46 and a lower opening 52 through which tie 20 passes. Upper opening 46 is formed by a recess 54 in top edge 56 of section 22 and a recess 58 in top edge 62 of section 24. Lower opening 52 is formed by a recess 64 in bottom edge 66 of section 22 and a recess 72 in bottom edge 74 of section 24. Openings 46 and 52 may alternatively be formed by a recess in just one of the adjacent section edges.

To use apparatus 10, the wearer places tie 20 around his neck and under his collar, in the ordinary tie wearing position. Then he releases fastening means 40, opens shell member 12 on hinge 30, and places wider end 16 and narrower end 18 into recesses 58 and 72. See FIG. 3. This positioning places hinge 30 and fastening means 40 on opposite sides of the longitudinal axis L of tie 20. Then the wearer pivots sections 22 and 24 together so that edges 34 and 36 meet, and then fastening means 40 are engaged to hold shell member 12 closed. This arrangement permits tie 20 to be freely positioned as the wearer chooses, and apparatus 10 simply slipped around tie 20 and closed with the thumb and index finger. No feeding of tie 20 through shell 12 is necessary.

Fastening means 40 may be any of several well known fastening mechanisms and preferably includes a stud 80 with a bead 78 on its free end, which extends perpendicularly from the inner surface 82 of section 22. A leg 84 extends from the inner surface 88 of section 24 opposite stud 80 and has a resilient stud receiving ring 86. See FIG. 3. Bead 78 removably snaps into ring 86.

A tie securing pin 90 optionally extends from inner surface 82 toward inner surface 88 to engage tie 20 when shell member 12 is closed. Alternatively, shall member 12 optionally has openings in side edges 26 and 28, and 34 and 36, to engagingly receive collar flaps 102 and 104 to hold apparatus 10 in place. Another alternative in shell member 12 design is to provide fastening means 40 on edges 26 and 28 as well, in place of hinge 30, so that sections 22 and 24 completely disengage from each other when shell member 12 is opened. Still another alternative is for shell member 12 to be a single piece which does not open. For this variation, wider end 16 and narrower end 18 of tie 20 would have to be fed down through openings 46 and 52. Still another alternative is for clips 112 to be provided on edges 26 and 28, and 34 and 36 to engage the front flaps 102 and 104 of collar 14. See FIG. 4.

lower opening 52 is preferably W-shaped with rounded corners. See FIG. 5. The peaks of the W are directed away from the wearer. This W shape bends the width of tie 20 into a convex shape with a longitudinal split 120 in the middle, resembling the aesthetically pleasing split created by a conventional knot. To enhance split 120, a wedge member 122 may extend from section 22 against tie 20, along the longitudinal axis of tie 20. See FIG. 5. Cross-sectional shapes for opening 52 other than that of a rounded W are also contemplated to create alternative tie 20 folds and contours.

Shell member 12 is preferably made of a hard, relatively inflexible material such as a metal or any suitable plastic. The outer surface 124 of section 22 may be colored to match or to favorably contrast with tie 20. Surface 124 may alternatively be bare metal, such as gold, silver or brass. Section 22 may alternatively be a transparent or translucent plastic, so that the color pattern of tie 20 shows through. As still another variation, some material matching that of tie 20 may be attached to outer surface 124. Finally, surface 124 may be contoured to resemble the shape of a conventional tie knot.

A special tie 130 maybe manufactured for use with apparatus 10. Since tie 130 is not actually tied when apparatus 10 is used, narrower end 18 extending behind wider end 16 of a conventional tie 20 can be omitted. Tie 130 consists only of wider end 16 and the portion which wraps around collar 14 and extends down to the knot area. See FIG. 6. This omission of end 18 would save as much as 40% of the tie material and a similar percentage of tie 20 manufacturing labor. A longitudinal series of dots 140 or other marks may be provided on tie 20 to permit rapid and certain positioning of tie 20 for various wearer heights. See FIG. 7.

Apparatus 10 may also be used to secure other clothing items, such belts, chokers, scarfs, and so forth. Apparatus 10 can also be made in different sizes to accommodate various widths of ties 20. Another alternative is for openings 46 and 52 to be large and to have a lower clip fastened to tie 20 or 130 just below shell member 12 to keep shell member 12 from sliding.

Second Preferred Embodiment

The second preferred embodiment of apparatus 10 is like the first, except that a loop member 150 is provided around and underneath collar 14. Loop member 150 may be a metal chain or a strip of fabric fastened at the front with a clasp or with hook and loop type fasteners such as VELCRO TM. See FIG. 8. For this embodiment, only wider end 16 of tie 20 is required. Thus a special tie 160 may be made for this embodiment which saves as much as 60% of tie 20 material. See FIG. 8. Attachment cords 162 extend from shell member 12 to loop member 150.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. A tie knot apparatus, comprising:

a front shell member having a top edge adjacent to a wearer's neck when worn, a bottom edge, and first and second side edges;

joining means on said first and second side edges of both of said front and rear shell members for joining said front and rear shell members together, and said front and rear shell members being configured at said top and bottom edges to form an upper shell member opening and a lower shell member opening when said rear shell and front shell are joined and said openings being for passing a necktie therethrough.

2. An apparatus according to claim 1, wherein said bottom edges are contoured at said lower shell member opening to create aesthetically appealing folds in said tie below said apparatus.

3. An apparatus according to claim 1, additionally comprising:

a wedge member secured to one of said shell members for pressing against said tie and creating an aesthetically appealing fold in said tie adjacent to said apparatus.

4. An apparatus according to claim 1, wherein one of said joining means comprises hinge means.

5. An apparatus according to claim 1, wherein said front shell member has an surface shaped to resemble the appearance of a tie knot.

6. An apparatus according to claim 1, additionally comprising:

a pin member extending from one of said shell members toward the other shell member for piercing a neck tie placed between said shell members and for securing said apparatus to said tie.

7. An apparatus according to claim 1, wherein one of said joining means removably fastens said shell members together.

8. An apparatus according to claim 1, additionally comprising a neck tie in the form of an elongate strip of flexible material, of a length permitting said neck tie to extend from the area of a wearer's trouser belt vertically upward and around the wearer's shirt collar and terminating just below said collar.

9. An apparatus according to claim 1, additionally comprising:

a loop member for fitting under a wearer's shirt collar, a support cord connecting said loop member to one said shell member.

10. An apparatus according to claim 9, wherein said loop member is an elongate strip of fabric having two ends and having loop fastening means at one of said ends.

11. An apparatus according to claim 9, wherein said loop member is a chain having two ends and having fastening means atone of said ends.

12. An apparatus for securing an elongate article of clothing, comprising:

a front shell member having a top edge adjacent to a wearer's neck when worn, a bottom edge, and first and second side edges, a rear shell member having a top edge, a bottom edge, and first and second side edges, joining means on said first and second side edges of both of said front and rear shell members for joining said front and rear shell members together, and said front and rear shell members being configured at said top and bottom edges to form an upper shell member opening and a lower shell member opening when said rear shell and front shell are joined and said openings being for passing said article of clothing therethrough.

* * * * *